United States Patent [19]

Thomas et al.

[11] Patent Number: 4,621,983

[45] Date of Patent: Nov. 11, 1986

[54] VARIABLE CAPACITY WOBBLE PLATE COMPRESSOR WITH IMPROVED MEANS FOR RETURNING LUBRICATING OIL TO CRANKCASE

[75] Inventors: David L. Thomas, Columbus, Ohio; Nobuhiko Suzuki, Konan, Japan

[73] Assignee: Diesel Kiki Co., Ltd., Japan

[21] Appl. No.: 722,797

[22] Filed: Apr. 12, 1985

[51] Int. Cl.[4] ..... F04B 1/28

[52] U.S. Cl. ..... 417/222; 417/270

[58] Field of Search ..... 417/269, 222, 270

[56] References Cited

U.S. PATENT DOCUMENTS

| | | | |
|---|---|---|---|
| 4,073,603 | 2/1978 | Henry | 417/270 |
| 4,283,997 | 8/1981 | Takahashi | 417/269 |
| 4,290,345 | 9/1981 | Hiraga | 417/269 |
| 4,480,964 | 11/1984 | Skinner | 417/270 |

*Primary Examiner*—William L. Freeh

*Attorney, Agent, or Firm*—Charles S. McGuire

[57] ABSTRACT

A variable capacity wobble plate compressor in which a pressure regulating valve is arranged across a communication passageway communicating between a high pressure chamber and a crankcase, wherein the crankcase pressure is controlled through selective closing and opening of said pressure regulating valve, to thereby vary the capacity of the compressor. An oil guide passage means communicates between a lower portion of the high pressure chamber and an inlet port of the pressure regulating valve. When the pressure regulating valve is open, lubricating oil which has collected in the high pressure chamber is returned to the crankcase through the oil guide passage means, the open pressure regulating valve, and part of the communication passageway.

8 Claims, 6 Drawing Figures

VARIABLE CAPACITY WOBBLE PLATE COMPRESSOR WITH IMPROVED MEANS FOR RETURNING LUBRICATING OIL TO CRANKCASE

BACKGROUND OF THE INVENTION

This invention relates to a variable capacity wobble plate compressor, and more particularly to a compressor of this kind which is adapted to compress refrigerant gas in an air conditioning system for automotive vehicles.

Already known, e.g. from Japanese Provisional Patent Publication (Kokai) No. 58-158382, which corresponds to U.S. Ser. No. 352,225 filed Feb. 25, 1982, now U.S. Pat. No. 4,428,718, is a variable capacity wobble plate compressor which employs a pressure regulating valve arranged across a communication passageway between the high pressure chamber and the crankcase with its bottom portion serving as an oil sump, wherein the pressure regulating valve is controlled to close and open the communication passageway so as to regulate the pressure within the crankcase to thereby vary the capacity of the compressor.

In compressors in general, lubrication of various sliding component parts is performed by lubricating oil entrained in compression fluid. The problem with such lubricating oil is that the oil is discharged into the refrigerating circuit from the crankcase together with the compression fluid in which it is mixed. A typical example of such phenomenon is the foaming of the oil stored in the bottom portion of the crankcase which tends to force lubricating oil at the start of the compressor, so that little or no oil is left within the crankcase.

In order to overcome such disadvantage, the following measures have conventionally been employed for instance:

(1) Return lubricating oil, which has flowed out of the oil sump in the crankcase, circulated in the refrigerating circuit and entered a piston cylinder during a suction stroke by means of blow-by during the piston compression stroke while entrained in the blow-by gas.

(2) Provide a passageway permanently communicating between the high pressure chamber and the crankcase so that lubricating oil separated from discharge compression fluid is returned to the crankcase through the passageway.

However, according to the former measure, the return rate of lubricating oil is too small to obtain a sufficient oil storage amount in the oil sump of the crankcase, while the latter measure suffers from degradation of the compression efficiency because part of the compression fluid once discharged into the high pressure chamber always flows to the crankcase through the aforementioned passageway during operation of the compressor.

A further measure would be to return to the crankcase lubricating oil separated from compression fluid in a zone under a lower pressure such as the suction pressure chamber. However, in a wobble plate compressor of the type concerned, generally the pressure within the crankcase is higher by 0.1–1.5 kg/cm$^2$ than that in the lower pressure zone, so there is no tendency for causing flow of lubricating oil from the lower pressure zone to the crankcase.

SUMMARY OF THE INVENTION

It is an object of the invention to provide a variable capacity wobble plate compressor which is capable of positively returning lubricating oil from the high pressure chamber to the crankcase without degradation of the compression efficiency.

It is a further object of the invention to provide a variable capacity wobble plate compressor which can reduce the amount of lubricating oil circulating in the refrigerating circuit, thereby minimizing the initial charging amount of lubricating oil, as well as improving the thermal efficiency during operation of the compressor.

The present invention provides a variable capacity wobble plate compressor including a high pressure chamber disposed to be supplied with discharge fluid with lubricating oil entrained therein, a crankcase having a bottom portion formed with an oil sump, a communication passageway communicating the high pressure chamber with the crankcase, a pressure regulating valve disposed across the communication passageway for selectively closing and opening same, and control means for controlling the pressure regulating valve to selectively close and open the communication passageway, whereby the pressure within the crankcase is controlled through selective closing and opening of the pressure regulating valve, to vary the capacity of the compressor. The invention is characterized by oil guide passage means communicating between a lower portion of the high pressure chamber and the inlet port of the pressure regulating valve, for guiding lubricating oil therethrough, whereby when the pressure regulating valve is open, lubricating oil which has collected in the high pressure chamber flows through the oil guide passage means, the open pressure regulating valve, and the crankcase pressure part of the communication passageway to the crankcase.

Preferably, the communication passageway includes a portion extending between a lower portion of the high pressure chamber and the inlet port of the pressure regulating valve. The oil guide passage means forms the above portion of the communication passageway.

Alternatively, the communication passageway may include a portion extending between an upper portion of the high pressure chamber and the inlet port of the pressure regulating valve, and the above portion of the communication passageway is separate from the oil guide passage means.

The above and other objects, features, and advantages of the invention will be more apparent from the ensuing detailed description taken in conjunction with the accompanying drawings.

DETAILED DESCRIPTION

Figure 1:
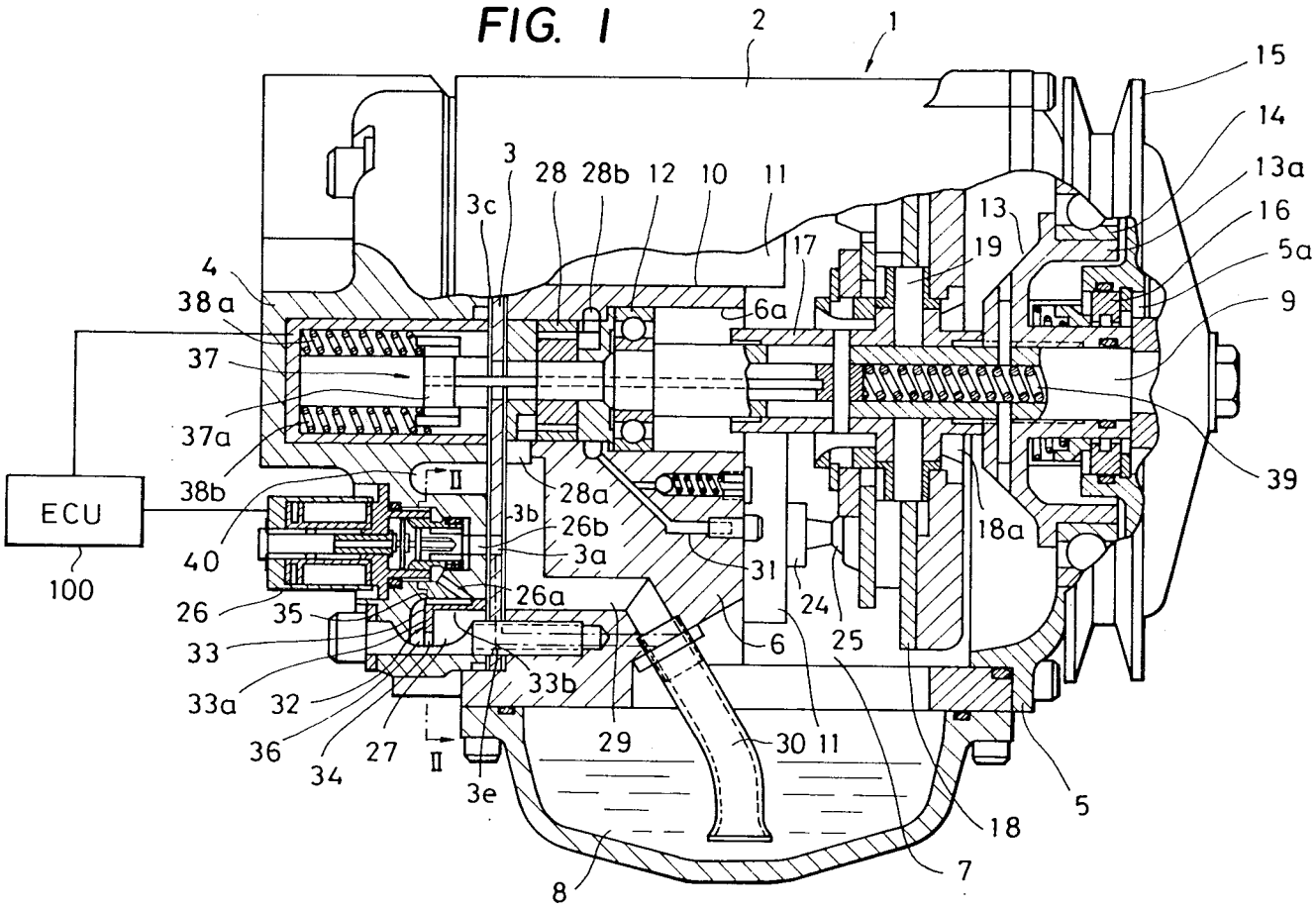
FIG. 1 is a side view, partly broken away, of a variable capacity wobble plate compressor according to a first embodiment of the invention.

The invention will now be described in detail with reference to the drawings illustrating embodiments thereof in which the invention is applied to a refrigerant gas compressor for use in an air conditioning system for automotive vehicles.

Referring first to FIG. 1 through FIG. 5, a first embodiment of the invention is illustrated which has a basic structure substantially identical with one shown in U.S. Ser. No. 608,514 filed May 9, 1984, now U.S. Pat. No. 4,553,905, issued Nov. 19, 1985, a prior application assigned to the present applicants' assignee. In the figures, reference numeral 1 designates a housing which comprises a cylindrical casing 2, a cylinder head 4 secured in a gastight manner to a left end face of the casing 2 as viewed in FIG. 1, via a valve plate 3, and a head 5 secured in a gastight manner to the other end face of the casing 2. The casing 2 accommodates a cylinder block 6 formed integrally therewith, of which an end face facing toward the head 5 defines a crankcase 7 in cooperation with an inner peripheral surface of the casing 2 and an inner surface of the head 5. An oil sump 8 is defined within the casing 2 at a bottom portion thereof and communicates with the interior of the crankcase 7. The cylinder block 6 is formed therein with a plurality of cylinders 10 circumferentially arranged around a drive shaft 9 and extending substantially parallel to the axis of the drive shaft 9. Pistons 11 are slidably received within respective ones of the cylinders 10. The drive shaft 9 is disposed substantially along the longitudinal axis of the housing 1, with an end portion thereof closer to the cylinder head 4 rotatably journalled via a ball bearing 12 in a central hole **6*a* formed in the cylinder block 6. The other end portion of the drive shaft 9 closer to the head 5 extends through a boss 13*a* of an arm member 13 and a large-sized ball bearing 14, and through the head 5 in a manner rotatably supported by these members. The same end portion of the drive shaft 9 closer to the head 5 further extends through a central hole 5*a* of the head 5, with its tip projected out of the head and carrying a pulley 15 rigidly fitted thereon. A mechanical sealing assembly 16 is interposed between the boss 13*a* of the arm member 13 and the central hole 5*a* of the head 5 to maintain gastightness between the crankcase 7 and the ambient. The pulley 15 is connected by a driving belt to a pulley on the output shaft of an engine installed in an automotive vehicle, none of which is shown, so that the rotation of the engine is transmitted to the drive shaft 9 through the these members and the pulley 15**.

A slider 17 in the form of a sleeve is fitted on an axially intermediate portion of the drive shaft 9 for axial sliding movement thereon while it is prohibited from rotating relative thereto, so that the slider 17 is rotatable together with the drive shaft 9. The slider 17 is urged by a coiled spring 39 toward the cylinder head 4. Further, a wobble plate 18 in the form of a disc is freely fitted on an axially intermediate portion of the slider 17 at its central through bore **18*a* and engages with the latter for pivoting about a first fulcrum or supporting point formed by trunnion pins 19 which are rotatably diametrically fitted in the inner peripheral wall of the central through bore 18*a* of the wobble plate 18. A side surface of the wobble plate 18 facing toward the head 5 is formed thereon with a pair of guide protuberances 20*a* radially extending parallel with each other at a predetermined location of the side surface, and an arm 13*b* of the arm member 13 has a convex camming surface 13*c* disposed in sliding contact with the side surface of the wobble plate 18 in a manner fitted between the guide protuberances 20*a*. The point of contact between the side surface of the wobble plate 18 and the camming surface 13*c* forms a second fulcrum for the wobble plate 18. The camming surface 13*c* has such a cam profile and a radial position as to cause displacement of the second fulcrum toward the axis of the drive shaft 9 through a substantial stroke with an increase in the angle of axial inclination of the wobble plate 18. Coiled springs 23 and 23 are connected between respective pairs of one of pins 21 and 21 projected from opposite outer side surfaces of the parallel guide protuberances 20*a*, 20*a* in opposite lateral directions, and a pin 22 transversely fitted through the arm 13*b* of the arm member 13 to maintain the side surface of the wobble plate 18 closer to the head 5 in urging contact with the camming surface 13*c***.

At the other side surface of the wobble plate 18 facing toward the cylinder block 6, a piston rod 24 of each of the pistons 11 has a spherical end **24*a* spherically engaged in a spherical bore 25*a* formed in a slipper shoe 25 to thereby drivingly connect the piston 11 to the wobble plate 18. The slipper shoe 25 is held in sliding contact with or close proximity with the above side surface of the wobble plate 18 by means of first and second holding members 29-1 and 29-2. Thus, the pistons 11 are slidingly moved within the respective cylinders 10 as the wobble plate 18 rotates. The angle of axial inclination of the wobble plate 18 relative to the vertical plane about the aforementioned second fulcrum is determined by the difference between resultant reaction force exerted by the pistons on the compression and suction strokes and pressure within the crankcase acting upon the pistons as back pressure. Accordingly, with a change in the pressure within the crankcase 7, the angle of axial inclination of the wobble plate 18 varies about the second fulcrum to vary the stroke amount of the pistons 11** to increase or decrease the capacity of the compressor.

Figure 3:
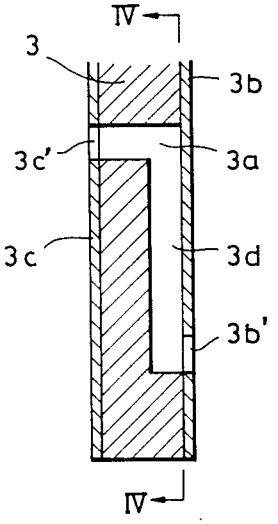
FIG. 3 is a vertical cross-sectional view of a rear valve plate in FIG. 1.
Figure 4:
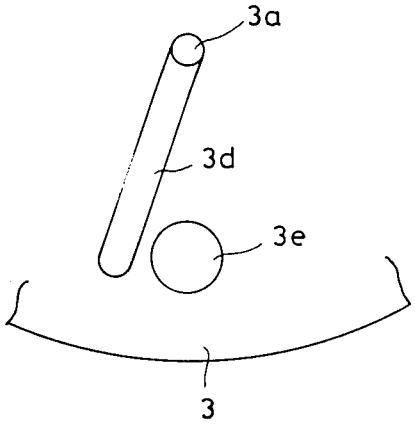
FIG. 4 is an end view of the valve plate taken along line IV—IV in FIG. 3.
Figure 5:
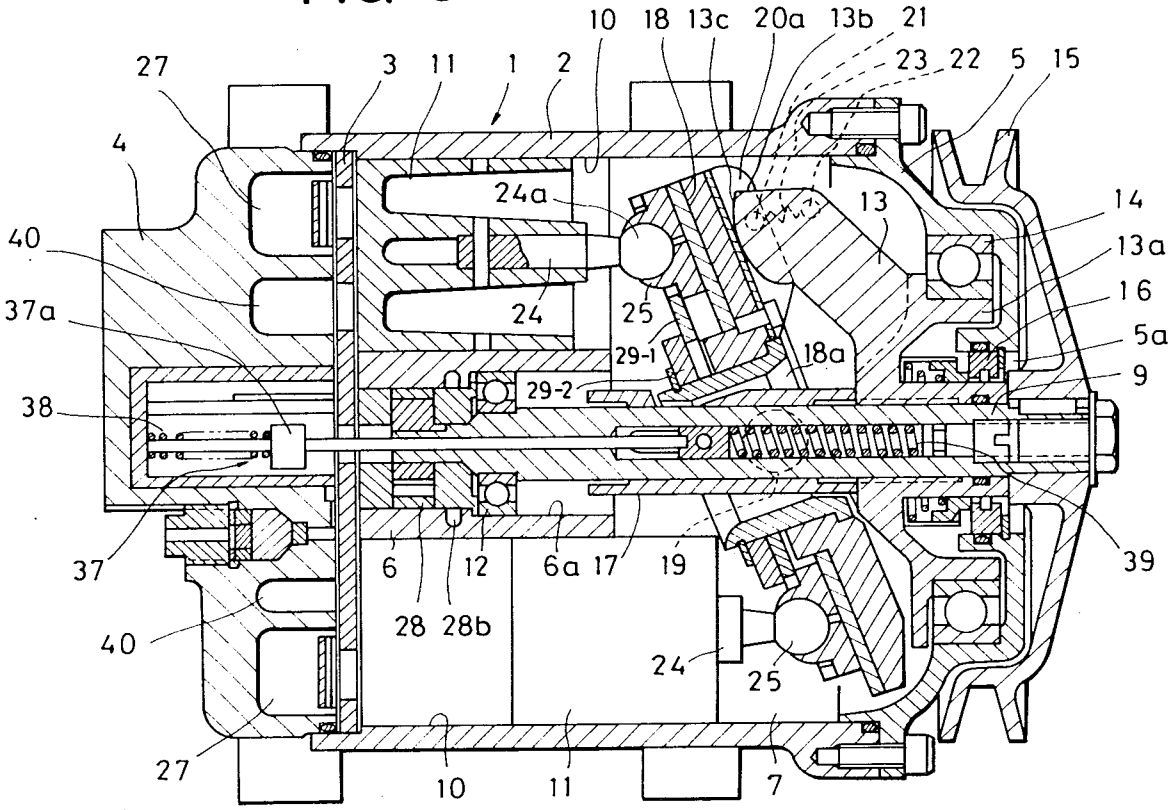
FIG. 5 is a horizontal longitudinal sectional view of the compressor in FIG. 1.

A pressure regulating valve 26 is provided to control the pressure within the crankcase 7. The valve 26 is a normally open type solenoid valve and mounted in the cylinder head 4, as shown in FIG. 1. More specifically, the valve 26 is arranged across a communication passageway communicating between the crankcase 7 and a high pressure chamber (discharge chamber) 27 which is annular in shape and defined between the cylinder head 4 and the valve plate 3. The pressure regulating valve 26 has an inlet port **26*a* communicating with the high pressure chamber 27 through an oil guide passage 32, hereinafter defined, and an outlet port 26*b* communicating with the crankcase 7 through a passageway indicated by the one-dot chain line in FIG. 1, which comprises a communication hole 3*a* formed through the valve plate 3, a groove 3*d* formed in the valve plate 3, a hole 3*b*' in the reed valve plate 3*b* and a passage formed in the cylinder block 6. Details of the passageway are shown in FIGS. 3 and 4. Incidentally, in FIGS. 3 and 4 reference numeral 3*e* denotes bolt-fitting holes for bolts fastening the cylinder head 4 to the cylinder block 6. An oil-feeding passage 29 is formed in the cylinder block 6, with one end communicating with a suction port 28*a* of an oil pump 28 and the other end opening into the crankcase 7. An oil guide tube 30 is fitted at one end in the open other end of the oil passage 29, and the tip or other end of the oil guide tube 30 is immersed in the oil in the oil sump 8. The oil pump 28 has a discharge port 28***b* connected to an oil guide passage 31 formed in the cylinder block 6 to supply lubricating oil to various sliding parts of the compressor.

Figure 2:
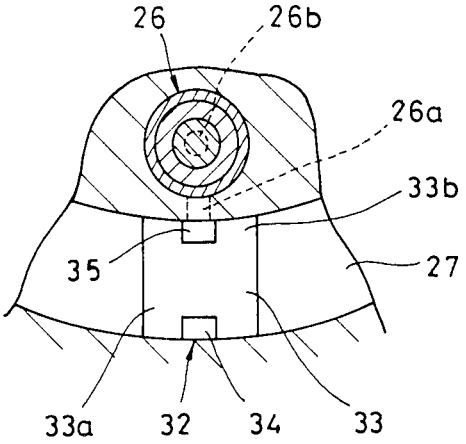
FIG. 2 is a transverse cross-sectional view taken along line II—II in FIG. 1.

The oil guide passage 32 extends between a lowermost portion of the high pressure chamber 27 and the inlet port 26*a* of the pressure regulating valve 26, as shown in FIGS. 1 and 2. The oil guide passage 32 is defined by a plate 33 of L-shaped cross section and opposed inner wall surfaces of the high pressure chamber 27. To be specific, a vertical side wall 33*a* of the plate 33 has its lower central end edge partially cut off to form a notch 34, and the upper wall 33*b* has a central portion thereof formed with a slot 35. The lower end edge of the vertical side wall 33*a* is disposed in contact with a lowermost inner wall surface, not shown, of the high pressure chamber 27, while the upper wall 33*b* is disposed in contact with an opposed wall surface of the high pressure chamber 27. With this arrangement, oil separated from discharge refrigerant gas and stored in the lowermost portion of the high pressure chamber 27 is guided through the notch 34 in the vertical side wall 33*a*, a gap 36 defined between the vertical side wall 33*a* and an opposed surface wall of the chamber 27, and the slot 35 in the ceiling wall 33*b* and delivered to the inlet port 26*a* of the pressure regulating valve 26.

The solenoid of the pressure regulating valve 26 is electrically connected to an output of an electronic control unit 100, and an output of a potentiometer 37 for sensing the angle of inclination of the wobble plate 18, to an input of the same control unit, respectively. The electronic control unit 100 operates to set a desired value of the capacity of the compressor in response to thermal load on the air conditioning system, and control the pressure regulating valve 26 in an on-off manner in response to the detected angle of inclination of the wobble plate 18 so as to make the actual capacity value or angle of inclination equal to the set desired capacity value. The potentiometer 37 is arranged within the cylinder head 4, and a slider 37*a* thereof is urged toward the drive shaft 9 by coiled springs 38*a* and 38*b*.

In FIGS. 1 and 3, reference numeral 40 designates a low pressure chamber (suction chamber) defined between the valve plate 3 and the cylinder head 4 and communicating with the crankcase 7 by way of an orifice, not shown.

The variable capacity wobble plate compressor according to the invention constructed as above operates as follows. When the pressure regulating valve 26 is in a deenergized state with no supply of electricity from the electronic control unit 100, the valve 26 is open to communicate the crankcase 7 with the high pressure chamber 27. Further, when the compressor is at rest, the slider 17 is biased by the coiled spring 39 in the leftward position as viewed in FIG. 1, to maintain the wobble plate 18 in its minimum angularity position. If on this occasion rotation of the engine is transmitted to the drive shaft 9 through the belt and the pulley 15, the drive shaft 9 is rotated together with the arm member 13 integral therewith, and then the rotating arm member 13 causes rotation of the wobble plate 18 in engagement with the tip of the arm 13*b*. When assuming the minimum angularity, the rotating wobble plate 18 causes stroke motions of the pistons 11 through a stroke length equal to several percent of their maximum stroke length. These stroke motions of the pistons 11 tend to cause a drop in the pressure within the low pressure chamber 40 and an increase in the pressure within the high pressure chamber 27. On this occasion, although low pressure refrigerant gas is guided from the low pressure chamber 40 into the crankcase 7 through the orifice, not shown, high pressure refrigerant gas is also simultaneously guided from the high pressure chamber 27 into the crankcase 7 by way of the inlet port 26*a* of the pressure regulating valve 26, the interior of the valve 26, the outlet port 26*b* thereof, the communication hole 3*a* and the groove 3*d* in the valve plate 3, the hole 3*b*' in the reed valve plate 3*b*, and the passage formed in the cylinder block. Consequently, no significant pressure difference occurs between the high pressure chamber 27, the low pressure chamber 40 and the crankcase 7 so that the wobble plate 18 is maintained in the minimum angularity position by the force of the coiled spring 39, whereby the compressor is running idle.

Next, when the pressure regulating valve 26 is energized by electricity supplied from the electronic control unit 100, it is closed to interrupt the communication between the crankcase 7 and the high pressure chamber 27, and then pressure tends to increase in the high pressure chamber 27 and tends to decrease in the low pressure chamber 40 and in the crankcase 7 due to stroke motions of the pistons 11. Consequently, the wobble plate 18 is displaced in the angularity-increasing direction to increase the displacement or stroke amount of the pistons 11 and accordingly increase the capacity of the compressor. The change in the angularity of the wobble plate 18 is detected by the potentiometer 37. When the capacity of the compressor represented by the detected angularity becomes equal to the aforementioned set desired capacity value, the electronic control unit 100 causes the pressure regulating valve to be opened. Then, the decrease of the crankcase pressure is stopped to interrupt the increase of the angularity of the wobble plate 18. Then, the introduction of high pressure refrigerant gas into the crankcase 7 causes an increase in the crankcase pressure, and accordingly a decrease in the angularity of the wobble plate 18 so that the pressure regulating valve 26 is again closed to displace the wobble plate 18 in the angularity-increasing direction.

The above operation is repeated when the capacity of the compressor decreases below or increases above a value required for the thermal load on the air conditioning system, or when the thermal load on the air conditioning system increases or decreases and eventually the capacity of the compressor becomes smaller than or larger than a value required for the thermal load. Thus, the compressor capacity is automatically controlled to optimum values.

During the above capacity control operation, each time the pressure regulating valve 26 is opened for regulation of the pressure within the crankcase 7, oil stored at the lowermost part of the high pressure chamber 27 is forced together with the high pressure fluid therein to travel in the oil guide passage 32 formed by the notch 34, the gap 36 and the slot 35 and then guided through the inlet port 26*a* and outlet port 26*b* of the valve 26, the communication hole 3*a*, and then through the aforementioned passages, into the crankcase 7. Therefore, oil in the high pressure chamber 27 can be positively returned into the crankcase 7 without a large pressure loss in the chamber 27, i.e. without degradation of the compression efficiency. Further, the percentage of oil circulated into the refrigerating circuit is reduced to thereby make it possible to reduce the initial charging amount of oil into the compressor as well as to achieve improved thermal efficiency during operation of the compressor.

Figure 6:
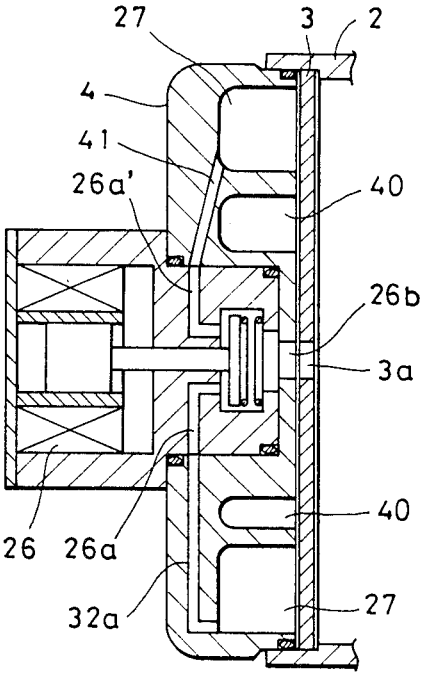
FIG. 6 is a longitudinal sectional view of essential part of a variable capacity wobble plate compressor according to a second embodiment of the invention.

A second embodiment of the invention will now be described with reference to FIG. 6. In FIG. 6, parts and elements corresponding to those in FIGS. 1–5 are designated by identical reference characters, and further detailed description of which is omitted. According to the second embodiment, the pressure regulating valve 26 is provided with two inlet ports 26*a* and 26*a'*. A fluid (refrigerant gas) guide passage 41 is formed in the cylinder head 4, which extends between the upper inlet port 26*a'* and an upper portion of the annular high pressure chamber 27 where fluid or refrigerant gas is present, to communicate therebetween, while an oil guide passage 32*a* is formed in the cylinder head 4, which extends between the lower inlet port 26*a* and a lower portion of the annular high pressure chamber 27 where oil is stored, to communicate therebetween. Thus, fluid or refrigerant gas can be smoothly returned from the high pressure chamber 27 to the crankcase 7 without its flow being impeded by oil in the same chamber 27.

While preferred embodiments have been described, variations thereto will occur to those skilled in the art within the scope of the present inventive concepts which are delineated by the following claims.

What is claimed is:

1. In a variable capacity wobble plate compressor including a high pressure chamber disposed to be supplied with discharge fluid with lubricating oil entrained therein, a crankcase having a bottom portion formed with an oil sump, a communication passageway communicating said high pressure chamber with said crankcase, a pressure regulating valve disposed across said communication passageway for selectively closing and opening same, said pressure regulating valve having an inlet port, and control means for controlling said pressure regulating valve to selectively close and open said communication passageway, whereby the pressure within said crankcase is controlled through selective closing and opening of said pressure regulating valve, to vary the capacity of said compressor, the improvement comprising oil guide passage means forming a portion of said communication passageway extending between a lower portion of said high pressure chamber and said inlet port of said pressure regulating valve, for guiding lubricating oil therethrough, whereby when said pressure regulating valve is open, lubricating oil which has collected in said high pressure chamber flows through said oil guide passage means, said open pressure regulating valve, and part of said communication passageway.

2. A variable capacity wobble plate compressor as claimed in claim 1, wherein said communication passageway includes a portion extending between said lower portion of said high pressure chamber and said inlet port of said pressure regulating valve, said oil guide passage means forming said portion of said communication passageway.

3. A variable capacity wobble plate compressor as claimed in claim 1, wherein said communication passageway includes a further portion extending between an upper portion of said high pressure chamber and said inlet port of said pressure regulating valve, said further portion of said communication passageway being separate from said oil guide passage means.

4. A variable capacity wobble plate compressor as claimed in claim 1, wherein said oil guide passage means comprises an L-shaped passage opening at a lower end thereof into said high pressure chamber, and an inlet port of said pressure regulating valve extending from an upper end of said L-shaped passage at an acute angle thereto.

5. A variable capacity wobble plate compressor as claimed in claim 1 wherein said pressure regulating valve comprises a solenoid actuated valve and said control means comprises an electronic control unit.

6. A variable capacity wobble plate compressor as claimed in claim 5 wherein said control means further include a potentiometer for sensing the angle of inclination of the wobble plate.

7. A variable capacity wobble plate compressor as claimed in claim 5 wherein said compressor includes a casing closed at one end by a cylinder head and wherein said potentiometer is arranged within said cylinder head.

8. In a variable capacity wobble plate compressor for an air conditioning system, including a high pressure chamber disposed to be supplied with discharge refrigerant gas with lubricating oil entrained therein, a crankcase having a bottom portion formed with an oil sump, a communication passageway communicating said high pressure chamber with said crankcase, a pressure regulating valve disposed across said communication passageway for selectively closing and opening same, said pressure regulating valve having an inlet port, and control means for controlling said pressure regulating valve to selectively close and open said communication passageway in response to thermal load on said air conditioning system, to control the pressure within said crankcase so that the capacity of said compressor becomes equal to a desired value appropriate to the thermal load, the improvement comprising oil guide passage means forming a portion of said communication passageway extending between a lower portion of said high regulating valve, for guiding lubricating oil therethrough, whereby when said pressure regulating valve is open, lubricating oil which has collected in said high pressure chamber is guided to said crankcase through said oil guide passage means, said open pressure regulating valve, and part of said communication passageway.

* * * * *